United States Patent [19]

Inoue et al.

[11] Patent Number: 4,517,273

[45] Date of Patent: May 14, 1985

[54] PRESSURE FIXABLE CAPSULE TONER

[75] Inventors: Sukejiro Inoue, Toride; Tetsuo Hasegawa, Tokyo; Yoshihiro Nishikawa, Kawasaki, all of Japan

[73] Assignee: Canon Kabushiki Kaisha, Tokyo, Japan

[21] Appl. No.: 565,532

[22] Filed: Dec. 29, 1983

Related U.S. Application Data

[63] Continuation of Ser. No. 263,607, May 14, 1981, abandoned, which is a continuation of Ser. No. 092,069, Nov. 7, 1979, abandoned.

[30] Foreign Application Priority Data

Nov. 9, 1978 [JP] Japan ..... 53-138187

[51] Int. Cl.[3] ..... G03G 9/16

[52] U.S. Cl. ..... 430/111; 428/402.24; 430/138

[58] Field of Search ..... 430/109, 138, 111; 428/402.24

[56] References Cited

U.S. PATENT DOCUMENTS

| | | | |
|---|---|---|---|
| 3,788,994 | 1/1974 | Wellman et al. | 430/109 |
| 3,830,750 | 8/1974 | Wellman | 430/138 |
| 3,893,932 | 7/1975 | Azar et al. | 430/109 |
| 3,974,078 | 8/1976 | Crystal | 430/138 |

*Primary Examiner*—John D. Welsh

*Attorney, Agent, or Firm*—Fitzpatrick, Cella, Harper & Scinto

[57] ABSTRACT

A pressure fixable capsule toner is composed of a pressure fixable core material covered with a coating material in which the main particle size of the capsule toner, a (microns), the main particle size of the core material, b (microns), and the hardness of the core material, y (dmm, by JIS-K2530) satisfy the formula:

$$0.01 \exp(a-b) \leqq y \leqq 5 \exp(a-b)$$

7 Claims, 1 Drawing Figure

PRESSURE FIXABLE CAPSULE TONER

This application is a continuation of application Ser. No. 263,607, filed May 14, 1981 which in turn is a continuation of Ser. No. 092,069 filed Nov. 7, 1979 both now abandoned.

BACKGROUND OF THE INVENTION

1. Field of the Invention

This invention relates to a toner for an electrophotographic process, electrostatic recording process, magnetic recording process or electrostatic printing process, and more particularly, to a capsule toner suitable for pressure fixation.

2. Description of the Prior Art

Heretofore there have been known various electrophotographic processes such as those disclosed in U. S. Pat. Nos. 2,297,691, 2,825,814, 3,220,324, and 3,220,831, British Pat. Nos. 1,165,406 and 1,165,405. These processes usually comprise utilizing a photoconductive material, forming electric latent images on a photosensitive member by some means, developing the latent images with a toner, if desired, transferring the developed toner images to a receiving sheet such as paper and then fixing the toner images by heat, pressure, or solvent vapor.

There are known various methods for visualizing electric latent images with a toner. For example, there may be mentioned magnetic brush development as described in U. S. Pat. No. 2,874,063 cascade development as described in U. S. Pat. No. 2,618,552 powder cloud development as described in U. S. Pat. No. 2,221,776, touchdown development as described in U. S. Pat. No. 2,895,847, fur-brush development, liquid development and the like. Toners used for these development methods are heretofore fine powders composed of dyes or pigments dispersed in natural or synthetic resins. If desired, third components are added to the fine powders.

Developed toner images may be transferred to a receiving sheet and fixed, if desired.

As a method of fixing toner images, there may be mentioned a method comprising heating and melting toner particles by a heater or heat roller and fusing followed by solidifying on the support, a method for fixing toner particles to a supporting member by softening or melting the resin binder in toner particles with an organic solvent, a method for fixing toner particles to a supporting member by pressure, and the like.

Materials for toner particles are selected in such a way that they are suitable for each particular fixing method. Therefore, a toner suitable for a particular fixing method is usually not usable for the other fixing methods.

In particular, a toner used for widely used, conventional heat fusing fixing methods employing a heater is hardly possible to be applied to a heat roller fixing method, a solvent fixing method, a pressure fixing method and the like. Therefore, toners suitable for each particular fixing method are researched and developed.

The method for fixing toners by pressure is for example, disclosed in U. S. Pat. No. 3,269,626 and Japanese Patent Publication No. 15876/1971. The method has various advantages, that is, less consumption of energy, non-pollution, copying without a waiting time by simply switching on a copying machine, no fear of burning and scorching copies, high speed fixing and a simple fixing device and the like.

However, the pressure fixing method has some disadvantages such as poor fixability of a toner, offsetting to the pressure roller, causing to wind paper on the pressure roller and the like. Therefore, researches have been made to improve the pressure fixation. For example, British Patent No. 1,210,665 discloses a pressure fixation toner containing an aliphatic component and a thermoplastic resin; U. S. Pat. No. 3,788,994, U. S. Pat. No. 3,974,078, Japanese Patent Laid Open Nos. 17739/1974 and 108134/1977 disclose pressure fixable toners of a capsule type containing a soft material in the core; and Japanese Patent Laid Open No. 75033/1978 discloses a pressure fixable toner composed of a block copolymer derived from a sticky and strong polymer and a soft polymer.

However, any practically satisfactory pressure fixable toner is not yet obtained which can be easily produced, has a sufficient pressure fixability, does not cause offsetting to the pressure roller, does not cause to wind paper on the pressure roller, is stable in points of developing property and fixability upon repeating use, does not adhere to carrier, metal sleeve and surface of the photosensitive member and has a good storage stability, i.e. non-agglomerative and non-caking.

For example, a pressure fixable toner comprising a soft material is of good pressure fixability, but is disadvantageous because this type of toner can not be easily pulverized to toner particles, easily causes offsetting to a pressure roller and adhering to a carrier and a surface of photosensitive member and causes agglomeration and caking during storage.

When a soft material of good pressure fixability is used as a core material in conventional pressure fixable capsule toners, the soft material gradually adheres to the pressure roller during repeating pressure fixation and at last this disadvantageously causes offsetting and the receiving paper is adhesively wound round the roller.

In addition, fluctuation of the fixability is so large that stable and practically satisfactory capsule toners have not yet been obtained.

There has been recently used a method of developing electrostatic images with a one-component developer which has toner particles containing magnetic fine powder and does not use any carrier particles. In this method the toner binder resin is required to have good dispersibility and contacting property with respect to the magnetic fine powders and the toner particles are required to have high impact strength and fludity. It is considerably difficult to render such desirable properties compatible with the pressure fixable property.

SUMMARY OF THE INVENTION

According to the present invention, there is provided a pressure fixable capsule toner comprising a pressure fixable core material covered with a coating material in which the main particle size of the capsule toner, a (microns), the main particle size of the core material, b (microns), and the hardness of the core material, y (dmm, by JIS-K2530) satisfy the formula:

$$0.01 \exp(a-b) \leqq y \leqq 5 \exp(a-b)$$

An object of the present invention is to provide a pressure fixable capsule toner which has a good and stable pressure fixability to ordinary paper and, in addition, shows a stable developing property and fixability even when used for producing many sheets of copy.

Another object of the present invention is to provide a pressure fixable capsule toner which neither causes offsetting to a pressure roller, nor adhere to carrier, developing sleeve and the surface of a photosensitive member.

A further object of the present invention is to provide a pressure fixable capsule toner of a good storage stability which neither agglomerates nor cakes during usage and storage.

Still another object of the present invention is to provide a pressure fixable capsule toner which has a good chargeability, shows a stable chargeability during using, and can produce clear and sharp images.

A still further object of the present invention is to provide a pressure fixable capsule toner which has a good pressure fixability, shows a good magnetic property and can be electrostatically transferred when the toner is used as one-component developer by incorporating magnetic powders in said toner or used as a magnetic toner for magnetic recording.

Still another object of the present invention is to provide a pressure fixable capsule toner which has a good durability and fluidity.

DESCRIPTION OF THE PREFERRED EMBODIMENT

Figure 1:
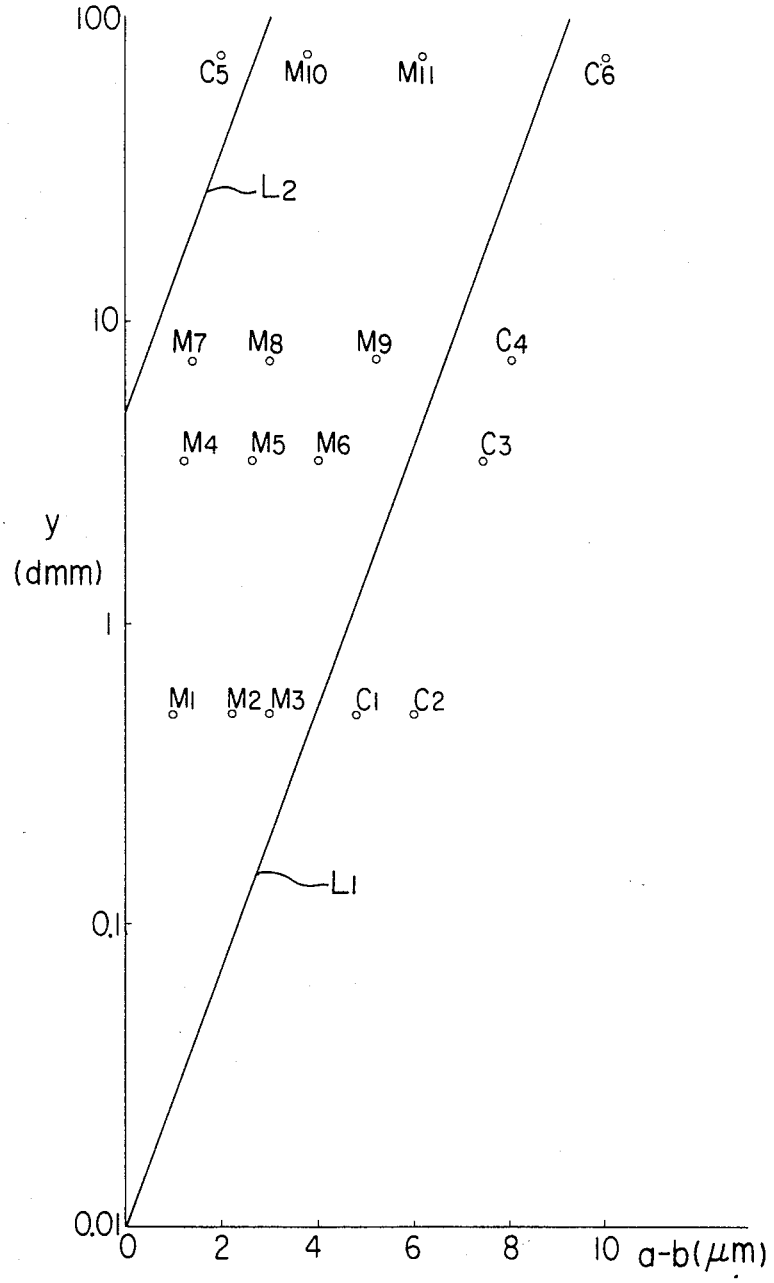
FIG. 1 shows a relation between (a−b) and y, and the data of Examples 1–11 and Comparison Examples 1–6 are plotted therein.

Characteristics of pressure fixable capsule toners are affected by material properties of the core material and the shell material (a wall covering the core) serving to improve chargeability and fluidity.

It has been found that hardness of the core material and thickness of the shell are closely related each other and properties of pressure fixable capsule toners are improved to a great extent when they satisfy a particular relation.

It was experienced upon preparation of capsule toners that capsule toners having stable properties were not always produced even when a core material of a good pressure fixability and a shell material having good chargeability and fluidity were selected and the ratio of the core material to the shell material was appropriately selected. The cause is that the particle size of a core material has a certain distribution and therefore, the resulting capsule toner has a certain distribution of particle size and the ratio of the core material to the shell material in each toner particle is not always within a desirable range and thereby, an appropriate shell thickness corresponding to the hardness of the core material can not be obtained.

Therefore, even if the resulting capsule toner particles are classified to arrange particle size distribution, capsule toners having stable properties can not be obtained.

It has been found that for the purpose of obtaining capsule toners which always have stable pressure flexability, chargeability, fluidity and the like, particle size distribution of the core material and that of the capsule toner should be carefully controlled and in addition, hardness of the core material and thickness of the shell material should be controlled to render their relation to be within a certain range. That is, the present inventors have found that pressure fixable capsule toner having stable characteristics can be obtained by appropriately controlling particle size distributions of the core material and the capsule toner and further controlling their particle size and hardness of the core material in such a way that the main particle size of the capsule toner, a (microns), the main particle size of the core material, b (microns), and the hardness of the core material, y (dmm, by JIS-K2530) satisfy the formula:

$$0.01 \exp(a-b) \leqq y \leqq 5 \exp(a-b)$$

and preferably $$0.03 \exp(a-b) \leqq y \leqq 3 \exp(a-b)$$

Core materials of various hardness (y dmm) and capsule toners having various kinds of thickness were used for experiments and it has been found that the capsule toners satisfying the above formula have stable characteristics.

For obtaining a desirable pressure fixability of toners. "y" is preferably not more than 300 dmm, more preferably, 0.1–100 dmm.

JIS-K2530 is a Japanese Industrial Standard concerning a degree of needle entering. The degree of needle entering is expressed by the distance (in a unit of 0.1 mm.) of a needle entering vertically a sample. This measurement is carried out at 25° C. with a load of 100 g. by using a particular needle for 5 seconds. The load is the total weight of the needle, a weight and a brass pipe. The particular needle is a steel round rod of 1.00–1.02 mm. in diameter, one end of which is ground to form a cone shape of about 6.35 mm. in height and 8°40′–9°40′ in angle and resulting tip is cut to form a cross section of 0.14–0.16 mm. in diameter. The resulting needle is hardened and ground sufficiently and then fitted to the center axis of a brass handle of about 3.2 mm. in diameter and about 32 mm. in length. The needle is fitted to a needle entering measuring device and used for measuring. The needle entering device is provided with such needle as mentioned above which can be pushed into by applying the load as mentioned above and a resistance to movement of the needle is very small and the length of needle which has entered the sample can be read up to 0.1 mm. by a graduated plate.

From the practical point of view, it is necessary for forming a shell that (a−b) is usually not less than 0.01 micron, preferably not less than 0.02 microns.

Particle size distributions of the core material and the capsule toner are controlled by controlling the main particle size and the width of particle size distribution of the other particle sizes. Main particle size means a particle size, the number of particles of which is the largest among the all particle sizes.

Number of particles having a certain particle size is measured by a particle analyzer, that is, an image of an optically enlarged particle group to be measured is converted to a video signal and the image information is transferred to a threshold circuit and changed to a digital image information, and then sent to a counting circuit. In the counting circuit, the particle sizes and number of particles are measured by using a scanning line of a television and points obtained by finely dividing the scanning line.

As a particle size analyzer, there may be mentioned LUZEX 450 manufactured by Japan Regulator K. K.

When core materials are first prepared and then are covered by a shell material to form capsule toners, the core material particles are preliminarily classified in the range of the main particle size ±3 microns and the shell material is applied to the core material particles. Further, after the capsule toner particles are produced, classifications are carried out to obtain a capsule toner which contains 70% or more of capsule toner particles having the main particle size ±3 microns.

However, if the particle size distribution can be set within a preferable distribution range by selecting appropriately the preparation conditions, classification is not always necessary as far as said preparation conditions are observed in the subsequent preparations.

In the above mentioned formula, as the value (a−b) is smaller than the defined range with respect to hardness of the core material, chargeability and fluidity of capsule toners are lowered and therefore, storage stability and durability are lowered by the resulting agglomeration.

On the contrary, when the value of (a−b) is higher than the defined range, the pressure fixability becomes remarkably poor though the chargeability and fluidity are kept at a desirable state.

As the pressure fixable component for the core material according to the present invention, there may be employed various components which have been used for core materials of conventional pressure fixable capsule toners. For example, there may be used a component which shows adhesivity under pressure or a component which shows adhesivity at a normal temperature and under normal pressure such as a soft material and a stickiness imparting agent, alone or in combination.

Any material having pressure fixability may be used as said component. Preferable materials are:

higher fatty acids such as stearic acid, palmitic acid, lauric acid and the like, polyolefins such as low molecular weight polyethylene, low molecular weight polypropylene, polyethylene oxide, polytetrafluoroethylene and the like, low molecular weight polystyrene, epoxy resins, polyester resins (acid value of not higher than 10), styrene-butadiene copolymer (monomer ratio of 5–30 to 95–70), ethylene-acrylic acid copolymer, ethylene-methacrylic acid copolymer, ethylene-vinyl acetate copolymer, polyvinylpyrrolidone, nethyl vinyl ether-maleic anhydride copolymer, maleic acid modified phenolic resisn, phenol modified terpene resins and the like.

As the shell material, there may be used various resins. Preferable resins are those which are insulating, have a good film shapeability, a good positive or negative chargeability, a good fluidity, non-agglomerating property, and do not disturb pressure fixability of the core material.

Such shell materials include homopolymers or copolymers of styrene or substituted styrene such as polystyrene, poly-p-chlorostyrene, polyvinyltoluene, styrene-butadiene copolymer, styrene-acrylic acid copolymer, styrene-maleic anhydride copolymer and the like, polyester resins, acrylic resins, xylene resins, polyamide resins, ionomer resins, furan resins, ketone resins, terpene resins, rosin, rosin modified pentaerythritol ester, natural resin modified phenolic resins, natural resin modified maleic acid resins, coumarone-indene resins, cycloaliphatic hydrocarbon resins, petroleum resins, phthalic acid cellulose acetate, starch graft polymer, polyvinylbutyral, polyvinylalcohol, and the like, and the above mentioned materials may be used alone or in combination.

Among them, styrene series resins having an average molecular weight of more than 1500, polyester resins, ionomer resins, phthalic acid cellulose acetate, starch graft polymers, and polyvinylbutyral are particularly preferable.

When the affinity and adhesivity between the core material and the shell material are not good, an intermediate adhesive layer may be disposed therebetween. The shell has only to cover the core material and have sufficient toner properties such as chargeability, fluidity and the like, and it is not always necessary that the shell completely cover the whole surface of the core material.

Charge control agents such as metal-containing dyes, nigrosine and the like which have been used for toner may be incorporated in the insulating material for the shell in an appropriate amount.

Further, it is possible to use powders of a charge control agent together with the toner particles (without incorporating the charge control agent into the toner particles).

If desired, dyes or pigments which have been used as a coloring agent for toners may be used for capsule toners according to the present invention, and such dye or pigment may be incorporated in one or both of the core material and the shell.

When a magnetic toner is desired, magnetic fine powders are incorporated in a toner. As the magnetic material, there may be used a material having magnetism or capable of being magnetized, for example, metal fine powders such as iron, manganese, nickel, cobalt, chromium and the like, various ferrites, alloys and compound of manganese, and ferromagnetic alloys. These magnetic fine powders may be incorporated in either the core material or the shell material. When an insulating toner is produced, it is preferable to incorporate magnetic fine powders in the core material.

Images produced by the capsule toner of the present invention can be fixed by passing between a pair of rollers under pressure, and if desired, auxiliary heating may be applied. The loaded pressure is usually 10–30 kg/cm. Pressure fixing apparatuses are disclosed in Japanese Patent Publication No. 12797/1969, U. S. Pat. Nos. 3,269,626, 3,612,682, 3,655,282, and 3,731,358.

The following examples are given for the purpose of illustration and not by way of limitation. In the examples, parts are weight unless otherwise specified.

EXAMPLES 1–3

As the core material, 100 parts of polyethylene oxide (density 0.99, degree of needle entering 0.5) and 10 parts of carbon black were sufficiently kneaded at about 150° C. for 30 min. by a roll-mill. The resulting core material was pulverized by using a cutter mill or a jet mill. The main particle size of the resulting finely divided core material was 14.5 microns. The resulting powders were classified to obtain 90% or more of powders having a particle size of 14.5±3 microns.

Then, the powders thus classified was sufficiently dispersed in a 10% solution of a styrene-butadiene copolymer in cyclohexane and dried by a spray drier to produce a capsule toner which has the styrene-butadiene copolymer as the shell material. Main particle size of the resulting capsule toner was 15.5 microns.

10 parts of the capsule toner and 90 parts of iron powder carrier (tradename, EFV 200/300, supplied by Nihon Teppun) were mixed to form a developer.

The resulting developer was placed in a developing vessel of a dry type electrophotographic copier (tradename, NP-5000, supplied by Canon K. K.) and the fixing device was replaced by a fixing roller device of Develop Co. (two rigid and chromium plated rollers, one roller being placed on the other roller and the total pressure being 460 Kg.). Continuous copying was carried out by using the developing and fixing apparatus as mentioned above, and there were produced fogless and sharp images of a good fixability. Further the continuous copying was continued up to 30,000 sheets of copy. The resulting images were as good as the images obtained at the beginning of the copying with respect to image quality and fixability.

The fixability was grade 5-6. The evaluation of fixability was carried out in a way similar to the dyeing fastness testing method as to friction (JIS-L 0849-1971), that is, a friction tester was used by rubbing the fixed surface of the toner with a white cotton cloth for friction according to the specified procedure (dry testing), and the degree of coloring of the white cotton cloth for friction was compared with the gray scale for dirtying to evaluate the fixability and show the result with "grade".

Following the procedure of the above example, thickness of the shell material was changed in various way (e.g., by changing the concentration of the shell material with respect to the amount of the core material employed) and the fixability and durability were tested. The results are shown in Table 1, Examples 2 and 3 and Comparison Examples 1 and 2.

EXAMPLES 4-6

The procedure of Example 1 was repeated except that a low molecular weight polyethylene (degree of needle entering 3.5, tradename, AC-6, supplied by Allied Chemical) was used as the core material. The main particle size of the core material was 16.0 microns. Pressure fixability and durability were tested using various thicknesses of the shell material. The results are shown in Table 1, Examples 4-6 and Comparison Example 3.

EXAMPLES 7-9

The procedure of Example 1 was repeated except that polyethylene (degree of needle entering 7.5, tradename, AC-617, supplied by Allied Chemical) was used as the core material. The main particle size of the core material was 18.0 microns. The pressure fixability and durability were tested by using various thicknesses of the shell material. The results are shown in Table 1, Examples 7-9 and Comparison Example 4.

When the core material was pulverized, some cooling was necessary.

EXAMPLES 10 and 11

Initial condensate of urea-formaldehyde was prepared in advance as follows.

20 parts of urea and 55 parts of 37% formaldehyde were mixed and 10% ethanolamine was added thereto to adjust the pH to 8.0 and stirred at 70° C. for 2.5 hours to produce a somewhat viscous and transparent urea-formaldehyde initial condensate.

24 parts of this initial condensate was dissolved in 180 parts of water and a warm 60% solution of an ethylenevinyl acetate copolymer (tradename, AC-430, supplied by Allied Chemical, degree of needle entering 75) in toluene was dispersed therein in a form of emulsion with stirring. Then to the resulting system was added citric acid in 2-3 portions to adjust to pH of this system to about 3.5 and the system was kept at 45°-50° C. with stirring for about 6 hours and then allowed to stand overnight. The precipitate thus produced was washed with water and dried to obtain core material particles. Most of the toluene contained in the nucleus were lost during the long agitation and there was obtained substantially solid core material. The degree of needle entering was 75 and the main particle size was 10 microns. Shell material of a styrene-butadiene copolymer was applied to the particles as in Example 1 and the fixability and durability were tested in a way similar to Example 1.

The results are shown in Table 1. In FIG. 1, the abscissa corresponds to (a−b) microns and the ordinate (logarithmic scale) corresponds to degree of needle entering y (dmm), and points $M_1$-$M_{11}$ correspond to Examples 1-11 and points $C_1$-$C_6$ correspond to Comparison Examples 1-6. $L_1$ and $L_2$ stand for y=0.01 exp (a−b) and y=5 exp (a−b), respectively.

TABLE 1

| Examples | Hardness of core material (y dm) | a-b (μ) | 0.01 exp (a-b) | 5 exp (a-b) | Fixability (grade) | Durability (sheets) |
|---|---|---|---|---|---|---|
| 1 | 0.5 | 1.0 | 0.03 | 13.6 | 5-6 | 40.000-50.000 |
| 2 | 0.5 | 2.2 | 0.09 | 45.1 | 5 | more than 50.000 |
| 3 | 0.5 | 3.0 | 0.2 | 100.4 | 4 | " |
| (Comparison Example 1) | 0.5 | 4.8 | 1.2 | 608 | 2-3 | " |
| (Comparison Example 2) | 0.5 | 6.0 | 4.0 | 2017 | 2-3 | " |
| 4 | 3.5 | 1.2 | 0.03 | 16.6 | 6 | " |
| 5 | 3.5 | 2.6 | 0.13 | 67.3 | 4-5 | " |
| 6 | 3.5 | 4.0 | 0.55 | 273 | 4 | " |
| (Comparison Example 3) | 3.5 | 7.4 | 16.4 | 8180 | 2-3 | 40.000-50.000 |
| 7 | 7.5 | 1.4 | 0.04 | 20.3 | 5 | 40.000-50.000 |
| 8 | 7.5 | 3.0 | 0.2 | 100.4 | 4-5 | more than 50.000 |
| 9 | 7.5 | 5.2 | 1.8 | 906 | 4-5 | " |
| (Comparison Example 4) | 7.5 | 8.0 | 29.8 | 14900 | 2-3 | " |
| 10 | 75 | 3.8 | 0.45 | 224 | 4-5 | 20.000 |
| 11 | 75 | 6.2 | 4.9 | 2460 | 4-5 | 20.000-30.000 |
| (Comparison | 75 | 2.0 | 7.4 | 37 | 4-5 | 500 |

TABLE 1-continued

| Examples | Hardness of core material (y dm) | a-b (μ) | 0.01 exp (a-b) | 5 exp (a-b) | Fixability (grade) | Durability (sheets) |
|---|---|---|---|---|---|---|
| Example 5) (Comparison Example 6) | 75 | 10.0 | 220 | 110000 | 2 | 20,000-30,000 |

EXAMPLES 12-33 and EXAMPLES 7-18

Repeating the procedures of Examples 1-11 and Comparison Examples 1-6 except that a phthalic acid cellulose acetate (reagent, supplied by Wako Junyaku, Japan) (used as an acetone solution) or a styrene-maleic anhydridebutyl acrylate copolymer (monomer ratio of 50/15/35 wt.%, tradename, Styrite X-4, supplied by Daido Kogyo) (used as a methyl ethyl ketone solution) was used as a shell material in place of styrene-butadiene copolymer, the results were almost the same as those when styrene-butadiene copolymer was used.

EXAMPLE 34 and COMPARISON EXAMPLE 19

Ethylene-vinyl acetate copolymer (tradename, AC401, supplied by Allied Chemical, degree of needle entering 4.0) was used as a core material and styrene-butadiene copolymer (monomer ratio, 15/85 wt.%, used in a form of a methyl ethyl ketone solution) was used as a shell material, and the procedure of Example 1 was followed and thickness of the shell material was changed. The resulting capsule toners were used as a developer. The results of the copying are shown in Table 2.

TABLE 2

| EXAMPLE | Hardness of Core Material (y dmm) | a-b (microns) | 0.01 exp (a-b) | 5 exp (a-b) | Fixability (grade) | Durability (sheets) |
|---|---|---|---|---|---|---|
| Example 34 | 4.0 | 3.0 | 0.2 | 100.4 | 5 | More than 20,000 |
| Comparsion Example 19 | 4.0 | 8.0 | 29.8 | 14900 | 2-3 | More than 20,000 |

What we claim:

1. A pressure fixable capsule toner comprising a pressure fixable core material encapsulated with a coating material in which the main particle size of the capsule toner, a in microns, the main particle size of the core material, b in microns, and the hardness of the core material, y in dmm, by Japanese Industrial Standard-K2530 satisfy the formula:

$$0.01 \exp(a-b) \leqq y \leqq 5 \exp(a-b),$$ wherein y is from 0.1-100 dmm and wherein 70% or more of the capsule toner particles are within (∓)3 microns of the main particle size, a.

2. A pressure fixable capsule toner according to claim 1 in which the core material contains polyolefin.

3. A pressure fixable capsule toner according to claim 2 in which the polyolefin is polyethylene.

4. A pressure fixable capsule toner according to claim 1 in which the coating material is 0.01 micron or more in thickness.

5. A pressure fixable capsule toner according to claim 1 in which the coating material is a styrene series polymer.

6. A pressure fixable capsule toner according to claim 1, in which the core material is a member selected from the group consisting of higher fatty acids, polyolefins, low molecular weight polystyrene, epoxy resins, polyester resins, styrene-butadiene copolymers, ethylene-acrylic acid copolymers, ethylene-methacrylic acid copolymers, ethylene-vinyl acetate copolymers, polyvinylpyrrolidone, methyl vinyl ether maleic anhydride copolymers, maleic acid-modified phenolic resins, and phenol-modified terpene resins.

7. A pressure fixable capsule toner according to claim 1, in which the coating material is a resin.

* * * * *